US005218204A

United States Patent [19]

Houk et al.

[11] Patent Number: 5,218,204

[45] Date of Patent: Jun. 8, 1993

[54] PLASMA SAMPLING INTERFACE FOR INDUCTIVELY COUPLED PLASMA-MASS SPECTROMETRY (ICP-MS)

[75] Inventors: Robert S. Houk; Ke Hu, both of Ames, Iowa

[73] Assignee: Iowa State University Research Foundation, Inc., Ames, Iowa

[21] Appl. No.: 888,620

[22] Filed: May 27, 1992

[51] Int. Cl.[5] ..... H01J 49/10

[52] U.S. Cl. ..... 250/288; 250/281; 250/289; 250/492.2

[58] Field of Search ..... 250/288 R, 288 A, 289, 250/281, 282, 492.2; 215/111.11, 111.31, 111.61

[56] References Cited

U.S. PATENT DOCUMENTS

| | | | |
|---|---|---|---|
| 3,944,826 | 3/1976 | Gray | 250/288 |
| 4,160,161 | 7/1979 | Horton | 250/288 A |
| 4,501,965 | 2/1985 | Douglas | 250/288 |
| 4,682,026 | 7/1987 | Douglas | 250/288 |
| 4,885,076 | 12/1989 | Smith et al. | 250/288 |
| 4,948,962 | 8/1990 | Mitsui et al. | 250/288 |
| 4,963,735 | 10/1990 | Okamoto et al. | 250/288 |

FOREIGN PATENT DOCUMENTS

| | | |
|---|---|---|
| 60-133648 | 7/1985 | Japan . |
| 62-64043 | 3/1987 | Japan . |
| 89/12313 | 12/1989 | PCT Int'l Appl. . |

OTHER PUBLICATIONS

D. J. Douglas, "Some Current Perspectives on ICP-MS", *Canadian Journal of Spectrometry*, vol. 34, No. 2, pp. 38–49, 1989.

M. Morita et al., "High Resolution Mass Spectrometry with Inductively Coupled Argon Plasma Ionization Source", *Analytical Sciences*, Oct. 1989, vol. 5, pp. 609–610.

N. Bradshaw et al., "Inductively Coupled Plasma as an Ion Source for High Resolution Mass Spectrometry", *Journal of Analytical Atomic Spectrometry*, Dec. 1989, vol. 4, pp. 801–803.

*Primary Examiner*—Paul M. Dzierzynski
*Assistant Examiner*—Kiet T. Nguyen
*Attorney, Agent, or Firm*—Antonelli, Terry, Stout & Kraus

[57] ABSTRACT

A plasma sampling interface for an inductively coupled plasma-mass spectrometry (ICP-MS) apparatus includes a sampler, a skimmer, insulating spacers for insulating the sampler and the skimmer from each other and from the remainder of the ICP-MS apparatus, and a DC bias voltage source for applying a DC bias voltage to the skimmer with the sampler either being grounded or being allowed to float. The plasma sampling interface increases the ion transmission through the ICP-MS apparatus by a factor of at least four to six over the ion transmission through a conventional ICP-MS apparatus in which both the sampler and the skimmer are grounded.

19 Claims, 4 Drawing Sheets

PLASMA SAMPLING INTERFACE FOR INDUCTIVELY COUPLED PLASMA-MASS SPECTROMETRY (ICP-MS)

GRANT REFERENCE

The United States Government has certain rights in the present invention pursuant to Grant No. ITA 87-02 between the U.S. Department of Commerce and Iowa State University.

BACKGROUND OF THE INVENTION

The present invention is directed to inductively coupled plasma-mass spectrometry (ICP-MS), and more particularly to an improved plasma sampling interface for an ICP-MS apparatus for sampling ions from an inductively coupled plasma and introducing the sampled ions to a mass spectrometer.

ICP-MS apparatuses are known in the art. In such apparatuses, an inductively coupled plasma (ICP) is produced by an ICP torch, a sample is introduced into the plasma where the sample is vaporized and ionized, and ions from the sample are sampled from the plasma by a plasma sampling interface and introduced to a mass spectrometer. The plasma sampling interface typically includes a sampler and a skimmer.

In a conventional ICP-MS apparatus, the sampler and the skimmer are usually grounded. U.S. Pat. No. 4,501,965 discloses an ICP-MS apparatus including a quadrupole mass spectrometer which appears to be such a conventional ICP-MS apparatus in that both the sampler and the skimmer appear to be grounded. However, a conventional ICP-MS apparatus can also be operated such that one or both of the sampler and the skimmer are not grounded.

For example, Japanese Patent Application Laid-Open No. 60-133648 discloses an ICP-MS apparatus including what appears to be a quadrupole mass spectrometer in which the sampler is grounded and a DC bias voltage is applied to the skimmer. Absent an English translation of this reference, it is unclear what the magnitude of the DC bias voltage is.

Japanese Patent Application Laid-Open No. 62-64043 discloses an ICP-MS apparatus in which (1) both the sampler and the skimmer are grounded; (2) the sampler is grounded and the skimmer is allowed to float; or (3) the sampler is grounded and the skimmer is connected to ground through a capacitor.

U.S. Pat. No. 4,682,026 discloses an ICP-MS apparatus including a quadrupole mass spectrometer in which (1) an RF bias voltage is applied to both the sampler and the skimmer; (2) the sampler is allowed to float and an RF bias voltage is applied to the skimmer; (3) the sampler is grounded and an RF bias voltage is applied to the skimmer; or (4) the sampler is allowed to float and the skimmer is grounded. The RF bias voltage is in the range of 1 to 10 volts peak-to-peak.

D. J. Douglas, "Some Current Perspectives on ICP-MS", *Canadian Journal of Spectroscopy,* Vol. 34, No. 2, 1989, pp. 38–49, discusses various ICP-MS apparatuses in which (1) both the sampler and the skimmer are grounded; (2) an RF bias voltage is applied to both the sampler and the skimmer; or (3) the sampler is grounded and an RF bias voltage is applied to the skimmer. The RF bias voltage is in the range of 1 to 10 volts peak-to-peak.

M. Morita et al., "High Resolution Mass Spectrometry with Inductively Coupled Argon Plasma Ionization Source", *Analytical Sciences,* October 1989, Vol. 5, pp. 609–610, discloses an ICP-MS apparatus with a sector-type mass spectrometer in which a bias voltage up to +5 kV is applied to the sampler. Although this reference does not specify what is done with the skimmer, it is likely that the skimmer is biased at the same voltage as the sampler.

N. Bradshaw et al., "Inductively Coupled Plasma as an Ion Source for High-resolution Mass Spectrometry", *Journal of Analytical Atomic Spectrometry,* December 1989, Vol. 4, pp. 801–803, discloses an ICP-MS apparatus with a double-focusing magnetic-sector mass spectrometer in which a bias voltage on the order of 4 kV is applied to both the sampler and the skimmer.

PCT International Application Publication No. WO 89/12313 discloses an ICP-MS apparatus with a double-focusing mass spectrometer in which a bias voltage in the range of +4 to +8 kV is preferably applied to both the sampler and the skimmer. A commercial device produced by the assignee of the PCT application operates in this fashion. This reference also discusses known ICP-MS apparatuses in which (1) the sampler is grounded or (2) the skimmer is allowed to float, but does not specify what is done with the skimmer in example (1) or with the sampler in example (2).

U.S. Pat. No. 4,948,962 discloses an ICP-MS apparatus with what appears to be a quadrupole mass spectrometer in which (1) the skimmer is set at a lower potential than the potential at the sampler; or (2) a potential difference is set between the sampler and the skimmer. This reference does not specify whether the sampler or the skimmer is grounded or allowed to float.

U.S. Pat. No. 4,963,735 discloses an ICP-MS apparatus in which (1) both the sampler and the skimmer are grounded; or (2) a DC bias voltage in the range from less than 100 V to more than 200 V is applied to both the sampler and the skimmer.

As known in the prior art, an ICP-MS apparatus can be used for chemical analysis. Alternatively, as disclosed in the applicants' copending U.S. patent application Ser. No. 07/888,613 filed concurrently with the present application and entitled "Ion Processing Apparatus Including Plasma Ion Source and Mass Spectrometer for Ion Deposition, Ion Implantation, or Isotope Separation", an ICP-MS apparatus can be used for ion processing such as ion deposition, ion implantation, or isotope separation.

In chemical analysis, it is desirable that the sensitivity of analysis performed by the ICP-MS apparatus be as high as possible. In ion processing such as ion deposition, ion implantation, or isotope separation, it is desirable that an ion beam produced by the ICP-MS apparatus be as intense as possible. Both the sensitivity of analysis and the intensity of the ion beam can be increased by increasing the ion transmission through the ICP-MS apparatus.

SUMMARY OF THE INVENTION

Therefore, an object of the present invention is to provide an ICP-MS apparatus for chemical analysis having a higher sensitivity of analysis than that attainable with a conventional ICP-MS apparatus.

Another object of the present invention is to provide an ICP-MS apparatus for ion processing such as ion deposition, ion implantation, or isotope separation producing an ion beam which is more intense than that produced by a conventional ICP-MS apparatus.

A further object of the present invention is to provide an ICP-MS apparatus in which the ion transmission through the ICP-MS apparatus is increased relative to that through a conventional ICP-MS apparatus.

In order to attain the foregoing objects of the present invention, an ICP-MS apparatus is provided with a plasma sampling interface including a sampler, a skimmer, insulating spacers for electrically insulating the sampler and the skimmer from each other and from the remainder of the ICP-MS apparatus, and an adjustable DC bias voltage source for applying a DC bias voltage in the range of 10 to 50 V to at least the skimmer.

In a first embodiment of the plasma sampling interface, the sampler is allowed to float and a DC bias voltage in the range of +20 to +30 V is applied to the skimmer. In a second embodiment of the plasma sampling interface, the sampler is grounded and a DC bias voltage in the range of +10 to +50 V is applied to the skimmer.

The DC bias voltage in the range of 10 to 50 V provided by the adjustable DC bias voltage source is suitable for use with an ICP-MS apparatus including a mass spectrometer requiring a low initial ion energy, such as a quadrupole mass spectrometer. For use with an ICP-MS apparatus including a mass spectrometer requiring a high initial ion energy, such as a magnetic-sector mass spectrometer, the plasma sampling interface includes a DC offset voltage source for applying a DC offset voltage at least between the DC bias Voltage source and ground.

The plasma sampling interface according to the present invention increases the ion transmission through an ICP-MS apparatus by a factor of at least four to six relative to the ion transmission through a conventional ICP-MS apparatus in which both the sampler and the skimmer are grounded. When the ICP-MS apparatus provided with the plasma sampling interface according to the present invention is used for chemical analysis, the increased ion transmission provides a higher sensitivity of analysis than that attainable with the conventional ICP-MS apparatus. When the ICP-MS apparatus provided with the plasma sampling interface according to the present invention is used for ion processing such as ion deposition, ion implantation, or isotope separation, the increased ion transmission provides an ion beam which is more intense than that produced by the conventional ICP-MS apparatus.

These and further objects, features, and advantages of the present invention will become more apparent from the following description when taken in conjunction with the accompanying drawings which show, for the purpose of illustration only, several embodiments of the present invention.

DESCRIPTION OF THE PREFERRED EMBODIMENTS

Figure 1:
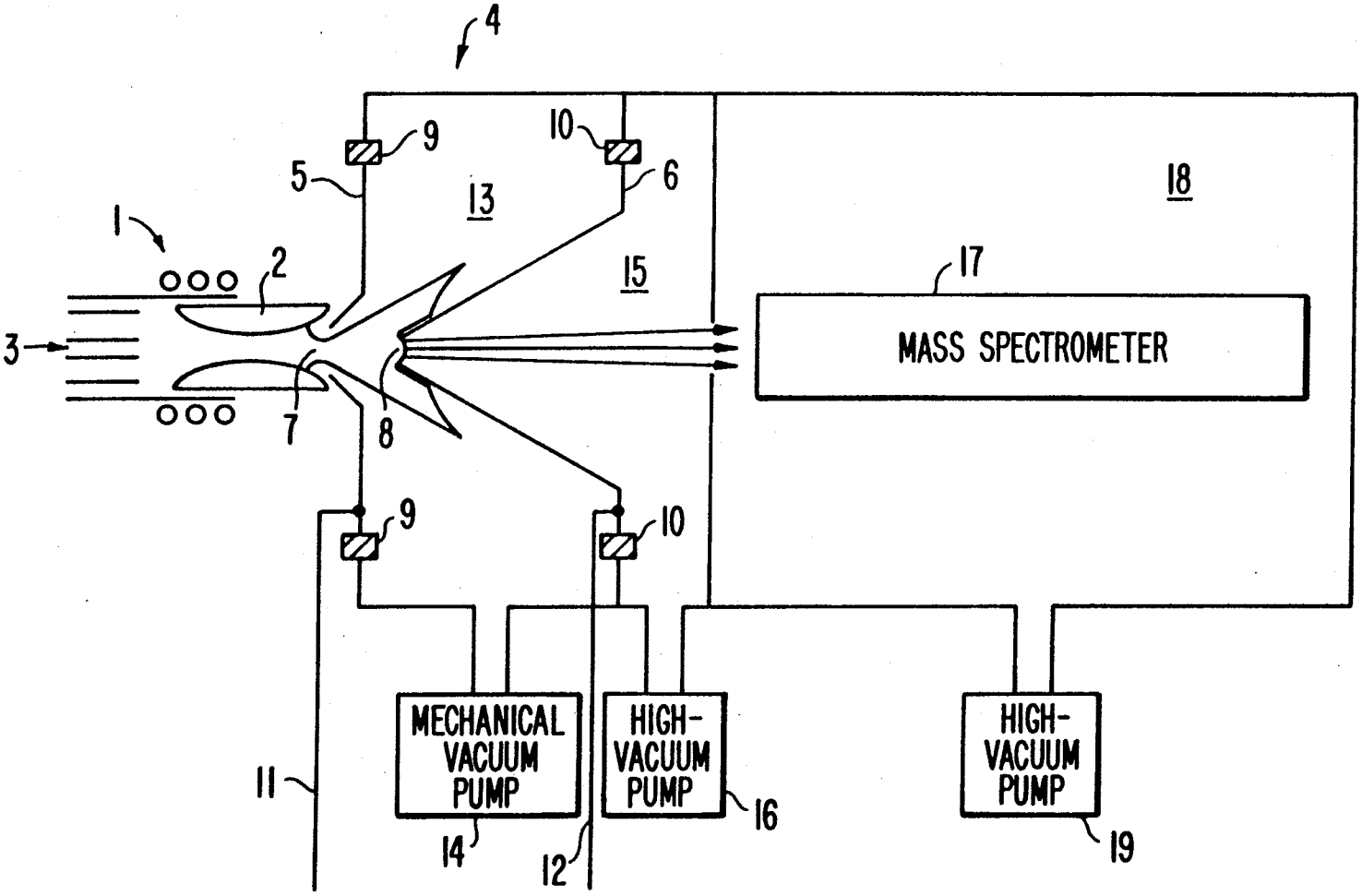
FIG. 1 shows an ICP-MS apparatus including a plasma sampling interface according to the present invention.

FIG. 1 shows an ICP-MS apparatus including a plasma sampling interface according to the present invention. A conventional ICP plasma torch 1 produces an ICP plasma 2. A sample 3 is introduced into the plasma 2 where the sample 3 is vaporized and converted into ions. Various methods of producing the sample 3 are known in the art, and thus will not be discussed in detail here. U.S. Pat. No. 3,944,826 is illustrative of such methods.

Ions from the sample 3 are sampled from the plasma 2 by a plasma sampling interface 4 including a sampler 5 and a skimmer 6 provided with respective orifices 7 and 8. The sampler 5 and the skimmer 6 are mounted on respective insulating spacers 9 and 10 to electrically insulate the sampler 5 and the skimmer 6 from each other and from the remainder of the ICP-MS apparatus, and are provided with respective leads 11 and 12 which enable respective bias voltages to be applied to the sampler 5 and the skimmer 6, or enable the sampler 5 and the skimmer 6 to be grounded or allowed to float.

A first vacuum chamber 13 between the sampler 5 and the skimmer 6 is evacuated by a mechanical vacuum pump 14 such as a rotary pump or a Roots pump to a pressure of approximately 1 torr. A second vacuum chamber 15 downstream from the skimmer 6 relative to the plasma 2 is evacuated by a high-vacuum pump 16 such as a diffusion pump to a pressure of approximately $10^{-4}$ torr. The ions sampled from the plasma 2 by the plasma sampling interface 4 are introduced to a conventional mass spectrometer 17 requiring a low initial ion energy (e.g. 5 to 15 eV), such as a quadrupole mass spectrometer. The mass spectrometer 17 is disposed in a third vacuum chamber 18 which is evacuated by a high-vacuum pump 19 to a pressure of approximately $10^{-6}$ torr.

The mass spectrometer 17 and the third vacuum chamber 18 are shown in simplified form inasmuch as these elements are conventional. However, it will be appreciated by one of ordinary skill in the art that a practical ICP-MS apparatus may include other elements in addition to the mass spectrometer 17 and the third vacuum chamber 18, such as ion transfer optics disposed in a vacuum chamber provided between the second vacuum chamber 15 and the third vacuum chamber 18 shown in FIG. 1. Such an ICP-MS apparatus is disclosed in the applicants' copending U.S. patent application Ser. No. 07,888,613 filed concurrently with the present application mentioned above.

The ICP-MS apparatus shown in FIG. 1 can be used in chemical analysis or for ion deposition, ion implantation, or isotope separation. In chemical analysis the mass spectrometer 17 is controlled to identify and measure the elements in the sampled ions. In ion deposition or ion implantation, the mass spectrometer 17 is controlled to produce from the sampled ions an ion beam having a high purity or a desired composition to be deposited onto the surface of a target or implanted into the target. Isotope separation is analogous to ion deposition or ion implantation except that the objective of isotope separation is to deposit or implant a significant amount of an element that is highly enriched in one particular isotope.

Figure 2:
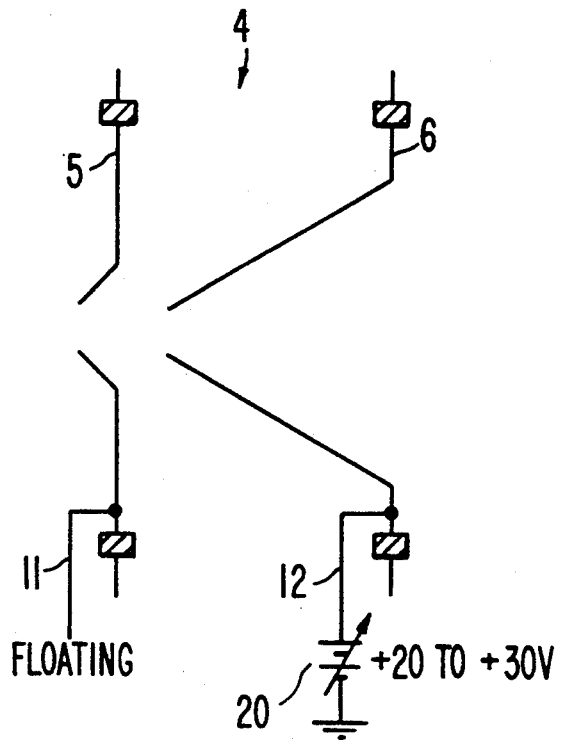
FIG. 2 shows an embodiment of the plasma sampling interface in which the sampler is allowed to float and a DC bias voltage is applied to the skimmer.

FIG. 2 shows a first embodiment of the plasma sampling interface 4 in which the sampler 5 is allowed to float, i.e. the lead 11 is not connected to ground or to any voltage source, and the adjustable DC bias voltage source 20 applies a DC bias voltage in the range of +20 to +30 V to the skimmer 6 via the lead 12. In a practical ICP-MS apparatus, the sampler 5 is usually cooled by water supplied through water cooling lines, and the sampler 5 is theoretically connected to ground through the water cooling lines. However, since the water cooling lines typically have a resistance on the order of 20 MΩ to ground, for all practical purposes the sampler 5 is not connected to ground, and therefore floats.

Figure 3:
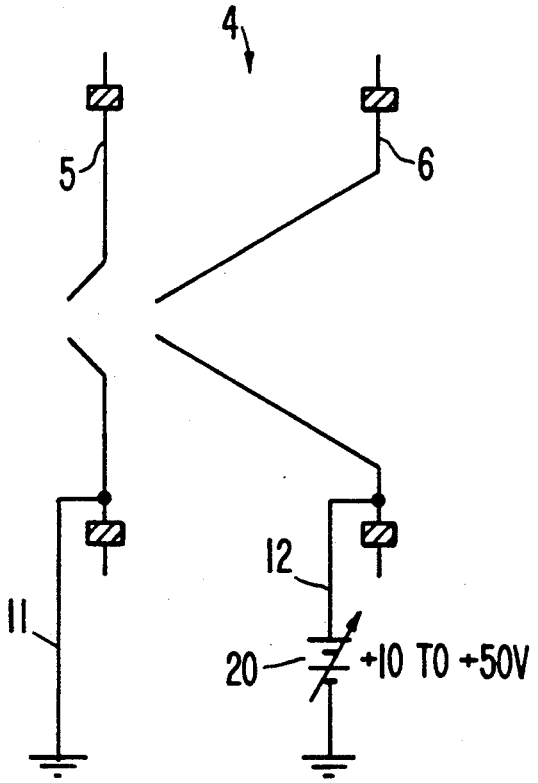
FIG. 3 shows a embodiment of the plasma sampling interface in which the sampler is grounded and a DC bias voltage is applied to the skimmer.

FIG. 3 shows a second embodiment of the plasma sampling interface 4 in which the sampler 5 is grounded via the lead 11 and the adjustable DC bias voltage source 20 applies a DC bias voltage in the range of +10 to +50 V to the skimmer 6 via the lead 12.

The embodiments shown in FIGS. 2-3 are suitable for use with an ICP-MS apparatus including a mass spectrometer 17 which requires a low initial ion energy (e.g. 5 to 15 eV), such as a quadrupole mass spectrometer. However, use of an ICP-MS apparatus including a mass spectrometer 17 which requires a high initial ion energy (e.g. 5 keV), such as a magnetic-sector mass spectrometer or a time-of-flight mass spectrometer, could be advantageous. The embodiments shown in FIGS. 2-3 can be modified to provide the higher initial ion energy required by such a mass spectrometer 17 by providing the plasma sampling interface 4 with a DC offset voltage source 21 for applying a DC offset voltage of approximately 5 kV at least between the DC bias voltage source 20 and ground as shown in FIGS. 4-5.

Figure 4:
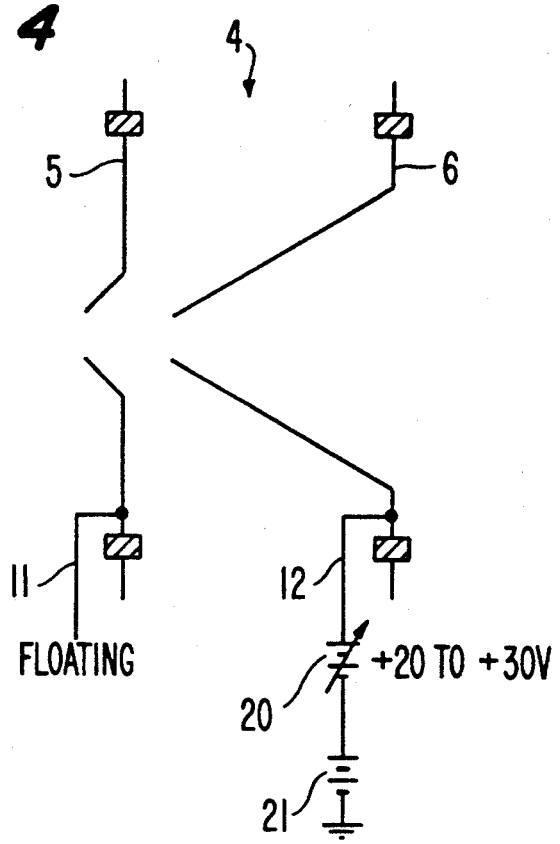
FIG. 4 shows the embodiment of the plasma sampling interface shown in FIG. 2 modified for use with a mass spectrometer requiring a high initial ion energy.
Figure 5:
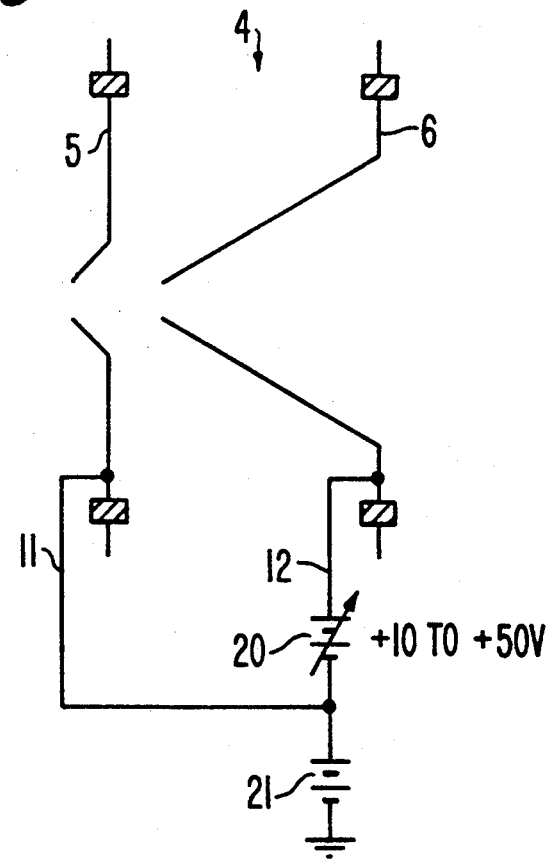
FIG. 5 shows the embodiment of the plasma sampling interface shown in FIG. 3 modified for use with a mass spectrometer requiring a high initial ion energy.

FIG. 4 shows a modification of the embodiment shown in FIG. 2 in which the sampler 5 is allowed to float and the DC offset voltage source 21 applies the DC offset voltage between the DC bias voltage source 20 and ground. FIG. 5 shows a modification of the embodiment shown in FIG. 3 in which the DC offset voltage source 21 applies the DC offset voltage to the sampler 5 via the lead 11 and between the DC bias voltage source 20 and ground.

The embodiments shown in FIGS. 2-5 improve the ion transmission through the ICP-MS apparatus shown in FIG. 1 by a factor of at least four to six relative to that through a conventional ICP-MS apparatus in which both the sampler and the skimmer are grounded.

Figure 6:
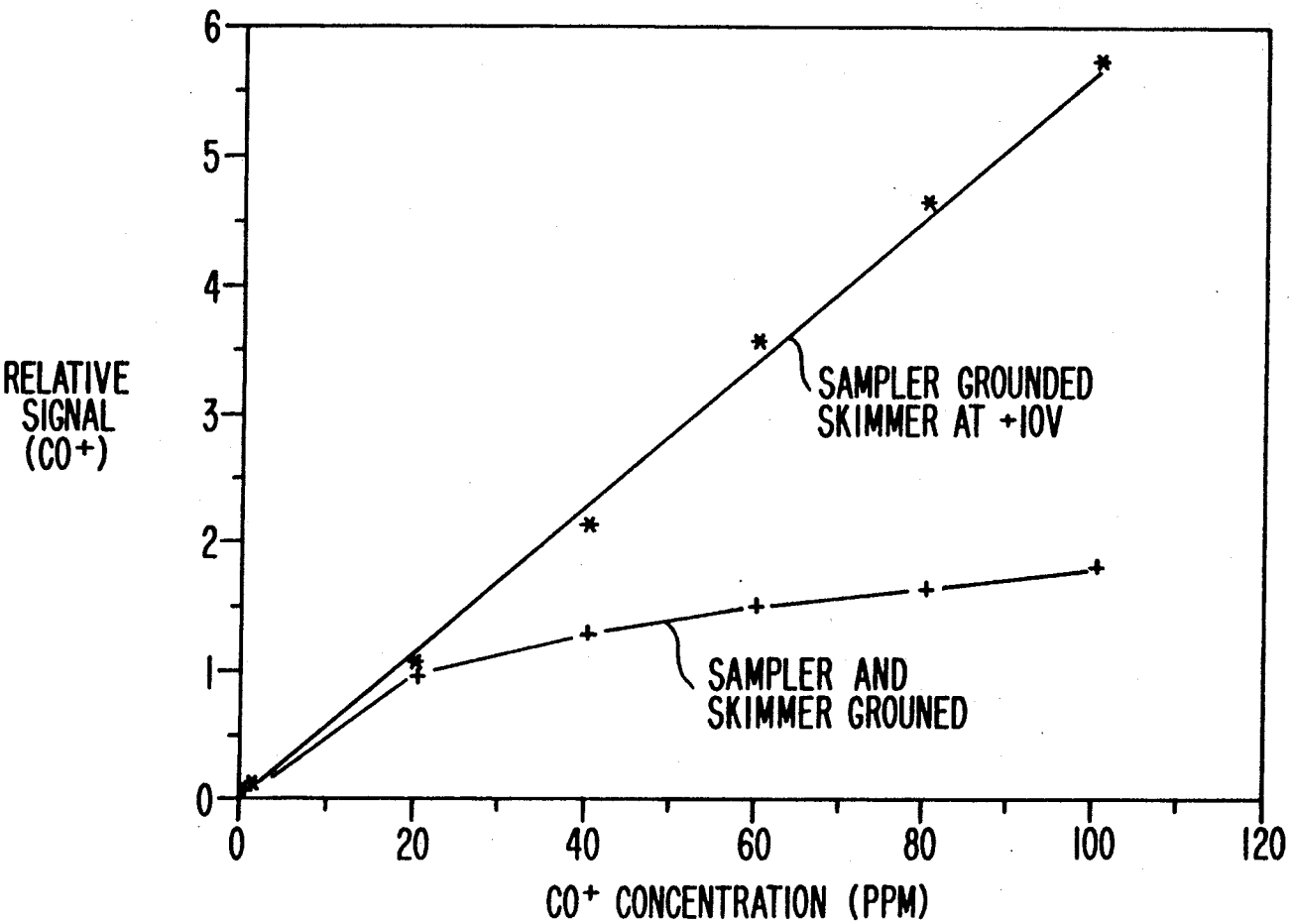
FIG. 6 shows an improved linear dynamic range in an ICP-MS apparatus provided by the embodiment of the plasma sampling interface shown in FIG. 3 compared to that provided by a conventional plasma sampling interface in which both the sampler and the skimmer are grounded.

FIG. 6 shows the results of tests comparing an ICP-MS apparatus provided with the plasma sampling interface 4 shown in FIG. 3 (sampler 5 grounded, DC bias voltage of +10 V applied to skimmer 6) with a conventional ICP-MS apparatus in which both the sampler and the skimmer are grounded. In the tests, samples of $Co^+$ in solution at concentrations of 20, 40, 60, 80, and 100 ppm were introduced into the plasma, the resulting ions were sampled by the plasma sampling interface, and the sampled ions were measured by the mass spectrometer. FIG. 6 shows the relative ion signal measured by the mass spectrometer versus the concentration of the $Co^+$ sample.

As can be seen from FIG. 6, the curve produced by the conventional ICP-MS apparatus is only linear up to 20 ppm where it rolls over and becomes non-linear. In contrast, the curve produced by the ICP-MS apparatus provided with the plasma sampling interface 4 shown in FIG. 3 is linear all the way up to 100 ppm. Thus, the plasma sampling interface 4 according to the present invention provides an increased linear dynamic range relative to that provided by the conventional plasma sampling interface in which both the sampler and the skimmer are grounded. Similar improvements in linear dynamic range were also obtained with the embodiment of the plasma sampling interface 4 shown in FIG. 2.

The increased linear dynamic range provided by the plasma sampling interface 4 according to the present invention enables a more concentrated sample 3 to be used to increase the intensity of an ion beam formed by mass spectrometer 17 for use in ion deposition, ion implantation, or isotope separation.

The optimum DC bias voltage to be applied to the skimmer as shown in FIGS. 2-5 and the optimum DC offset voltage as shown in FIGS. 4-5 are generally determined empirically, for example by monitoring a mass spectral peak of interest and adjusting the DC bias voltage and the DC offset voltage to maximize the ion signal measured by the mass spectrometer while still retaining acceptable peak shape and resolution.

While the present invention has been described in some detail with respect to the particular embodiments shown in FIGS. 1-5, it will be appreciated by one of ordinary skill in the art that the present invention is subject to many modifications. The present invention is intended to encompass all such modifications, and the scope of the present invention is to be determined solely with reference to the appended claims.

We claim:

1. A plasma sampling interface for an inductively coupled plasma-mass spectrometry (ICP-MS) apparatus, the plasma sampling interface enabling sampling of ions from an inductively coupled plasma and introducing the sampled ions to a mass spectrometer, the ions to be sampled being from a sample which has been vaporized and converted into ions in the plasma, the plasma sampling interface comprising:

a sampler disposed adjacent the plasma and a skimmer disposed downstream from the sampler relative to the plasma, the sampler and the skimmer enabling sampling of the ions from the plasma and introducing the sampled ions to the mass spectrometer;

insulating means for electrically insulating the sampler and the skimmer from each other and from a remainder of the ICP-MS apparatus; and a DC bias voltage source for applying a DC bias voltage to the skimmer;

wherein the sampler is one of grounded and allowed to float.

2. A plasma sampling interface according to claim 1, wherein the DC bias voltage source is an adjustable DC bias voltage source for applying an adjustable DC bias voltage in the range of 10 to 50 V to the skimmer.

3. A plasma sampling interface according to claim 1, wherein the sampler is allowed to float, and the DC bias voltage source applies a DC bias voltage in the range of 10 to 50 V to the skimmer.

4. A plasma sampling interface according to claim 3, wherein the DC bias voltage source applies a DC bias voltage in the range of +20 to +30 V to the skimmer.

5. A plasma sampling interface according to claim 1, wherein the sampler is grounded, and the DC bias voltage source applies a DC bias voltage in the range of 10 to 50 V to the skimmer.

6. A plasma sampling interface according to claim 5, wherein the DC bias voltage source applies a DC bias voltage in the range of +10 to +50 V to the skimmer.

7. A plasma sampling interface according to claim 1, wherein the mass spectrometer is a mass spectrometer requiring a low initial ion energy.

8. A plasma sampling interface according to claim 7, wherein the mass spectrometer is a quadrupole mass spectrometer.

9. A plasma sampling interface according to claim 1, wherein the mass spectrometer is a mass spectrometer requiring a high initial ion energy, and wherein the plasma sampling interface further comprises a DC offset voltage source for applying a DC offset voltage at least between the DC bias voltage source and ground.

10. A plasma sampling interface according to claim 9, wherein the mass spectrometer is a magnetic-sector mass spectrometer.

11. A plasma sampling interface according to claim 9, wherein the mass spectrometer is a time-of-flight mass spectrometer.

12. A plasma sampling interface according to claim 9, wherein the sampler is allowed to float, the DC bias voltage source applies a DC bias voltage in the range of 10 to 50 V to the skimmer, and the DC offset voltage source applies the DC offset voltage between the DC bias voltage source and ground.

13. A plasma sampling interface according to claim 12, wherein the DC bias voltage source applies a DC bias voltage in the range of +20 to +30 V to the skimmer.

14. A plasma sampling interface according to claim 9, wherein the DC bias voltage source applies a DC bias voltage in the range of 10 to 50 V to the skimmer, and the DC offset voltage source applies the DC offset voltage to the sampler and between the DC bias voltage source and ground.

15. A plasma sampling interface according to claim 14, wherein the DC bias voltage source applies a DC bias voltage in the range of +10 to +50 V to the skimmer.

16. An inductively coupled plasma-mass spectrometry (ICP-MS) apparatus comprising:

an inductively coupled plasma torch for producing an inductively coupled plasma;

sample introducing means for introducing a sample into the plasma where the sample is vaporized and converted into ions;

a sampler disposed adjacent the plasma and a skimmer disposed downstream from the sampler relative to the plasma, the sampler and the skimmer being provided for sampling the ions from the plasma;

insulating means for electrically insulating the sampler and the skimmer from each other and from a remainder of the ICP-MS apparatus;

a DC bias voltage source for applying a DC bias voltage to the skimmer; and a mass spectrometer to which the ions sampled by the sampler and the skimmer are introduced;

wherein the sampler is one of grounded and allowed to float.

17. An apparatus according to claim 16, wherein the mass spectrometer is controlled to identify and measure elements in the sampled ions, thereby performing chemical analysis of the sampled ions.

18. An apparatus according to claim 16, wherein the mass spectrometer is controlled to produce from the sampled ions an ion beam having one of a high purity and a desired composition for being one of deposited onto a surface of a target and implanted into a target, thereby performing one of ion deposition and ion implantation.

19. An apparatus according to claim 16, wherein the mass spectrometer is controlled to produce from the sampled ions an ion beam highly enriched in a desired isotope for being one of deposited onto a surface of a target and implanted into a target, thereby performing isotope separation.

* * * * *